US010729192B2

(12) United States Patent
Quirk

(10) Patent No.: US 10,729,192 B2
(45) Date of Patent: Aug. 4, 2020

(54) HAND AND THUMB PROTECTION AND SUPPORT FOR AN ATHLETIC GLOVE

(71) Applicant: REINFORCE THE GAME, LLC, Swampscott, MA (US)

(72) Inventor: Luz Quirk, Sawmpscott, MA (US)

(73) Assignee: REINFORCE THE GAME, LLC, Swampscott, MA (US)

( * ) Notice: Subject to any disclaimer, the term of this patent is extended or adjusted under 35 U.S.C. 154(b) by 259 days.

(21) Appl. No.: 15/813,481

(22) Filed: Nov. 15, 2017

(65) Prior Publication Data

US 2018/0132553 A1 May 17, 2018

Related U.S. Application Data

(60) Provisional application No. 62/423,332, filed on Nov. 17, 2016.

(51) Int. Cl.

| | |
|---|---|
| ***A41D 19/015*** | (2006.01) |
| ***A41D 19/00*** | (2006.01) |
| ***A63B 71/14*** | (2006.01) |
| *A63B 102/14* | (2015.01) |
| *A63B 102/22* | (2015.01) |
| *A63B 102/24* | (2015.01) |

(52) U.S. Cl.

CPC ... *A41D 19/01588* (2013.01); *A41D 19/0013* (2013.01); *A41D 19/0048* (2013.01); *A41D 19/01523* (2013.01); *A63B 71/141* (2013.01); *A63B 71/148* (2013.01); *A41D 19/001* (2013.01); *A63B 71/143* (2013.01); *A63B 71/145* (2013.01); *A63B 2102/14* (2015.10); *A63B 2102/22* (2015.10); *A63B 2102/24* (2015.10)

(58) Field of Classification Search

CPC ..... A41D 19/01588; A41D 19/0013; A41D 19/0048; A41D 19/01523; A63B 71/148

See application file for complete search history.

(56) References Cited

U.S. PATENT DOCUMENTS 3,882,548 A * 5/1975 Shinagawa ..... A41D 19/01523 2/20
4,964,174 A * 10/1990 Martin ..... A41D 19/0055 2/161.8
5,214,799 A * 6/1993 Fabry ..... A41D 19/01523 2/161.6

(Continued)

*Primary Examiner* — Richale L Quinn
(74) *Attorney, Agent, or Firm* — DLA Piper LLP

(57) ABSTRACT

An athletic glove having an inner glove with one or more protective members is discussed. Protective members may include metacarpal support members attached to the dorsal side of the inner glove configured to protect at least a portion of a metacarpal bone of the human hand; volar and dorsal metacarpal support member attached to the volar and dorsal sides of the inner glove, respectively, and configured to protect at least a portion of a carpometacarpal joint, a metacarpal bone, a metacarpal joint, and a proximal phalanx of a thumb of the human hand; and volar and dorsal distal phalange support members attached to the volar and dorsal sides, respectively, of the inner glove and configured to protect at least a portion of a distal phalanx of the thumb of the human hand. Optionally, the inner glove may include a protective strap.

12 Claims, 5 Drawing Sheets

(56) References Cited

U.S. PATENT DOCUMENTS

| | | | | |
|---|---|---|---|---|
| 5,640,712 | A * | 6/1997 | Hansen | A41D 19/01523 2/16 |
| 9,198,474 | B1 * | 12/2015 | Hacobian | A41D 19/01505 |
| 9,629,402 | B2 * | 4/2017 | Albertyn | A41D 19/01505 |
| 9,867,413 | B2 * | 1/2018 | Blecherman | A42B 3/0473 |
| 10,207,665 | B2 * | 2/2019 | Gandhi | B60R 19/20 |
| 2007/0150999 | A1 * | 7/2007 | Brown | A41D 19/0048 2/159 |
| 2008/0010719 | A1 * | 1/2008 | Hoelscher | A41D 19/01588 2/161.1 |
| 2008/0060115 | A1 * | 3/2008 | Morris | A41D 19/01523 2/159 |
| 2011/0107498 | A1 * | 5/2011 | Chang | A41D 19/01588 2/163 |
| 2012/0011633 | A1 * | 1/2012 | Van Hale | A41D 19/002 2/20 |
| 2012/0017351 | A1 * | 1/2012 | McCrane | A63B 71/141 2/161.1 |
| 2012/0159681 | A1 * | 6/2012 | Gibby | A41D 13/0156 2/20 |
| 2012/0311754 | A1 * | 12/2012 | Safford | A41D 19/015 2/20 |
| 2015/0040288 | A1 * | 2/2015 | Gaff | A63B 71/148 2/161.1 |
| 2015/0223542 | A1 * | 8/2015 | Fischell | A42B 3/0473 2/461 |
| 2018/0303176 | A1 * | 10/2018 | Lim | G06F 3/014 |

* cited by examiner

HAND AND THUMB PROTECTION AND SUPPORT FOR AN ATHLETIC GLOVE

CROSS-REFERENCE TO RELATED APPLICATIONS

This application claims the benefit of U.S. Provisional Application No. 62/423,332 filed on Nov. 17, 2016, which is incorporated by reference in its entirety.

TECHNICAL FIELD

The present disclosure relates to athletic protective equipment and athletic protective garments. More particularly, the disclosure relates to an improved athletic glove providing hand and thumb protection to an athlete.

BACKGROUND

Athletes including lacrosse players, hockey players, baseball players, softball players, soccer players, and the like are at increased risk for hand injuries. For example, lacrosse, hockey and soccer are high contact sports where goalies are prone to hand and thumb fractures. This is due in part to the high shooting velocities and high density balls associated with each of these sports and the mechanics of being a goalie whose role it is to stop or deflect the high density ball that is moving at a high velocity. To protect their hands and thumbs, goalies may wear protective equipment such as gloves. However, conventional gloves do not provide sufficient protection to the metacarpal bones and related joints of the hand and thumb. Additionally, conventional protective gloves may not provide sufficient protection to the hands and thumbs of a goalie because in conventional protective gloves protection is provided on the exterior of the glove. Additionally, conventional protective gloves may be stiff and prevent the goalie from having a free-range of motion, thereby inhibiting the goalie's ability to perform in an athletic setting.

Accordingly there remains a need for protection equipment and protective wear that provides sufficient hand and thumb protection to an athlete.

SUMMARY

The present disclosure relates to an athletic glove including an inner glove having a base layer sized to cover a palm, thumb, and at least a portion of the fingers of a human hand. The base layer may have a dorsal side configured to span a dorsal aspect of the human hand and a volar side configured to span a volar aspect of the human hand. The athletic glove may have one or more metacarpal support members attached to the dorsal side of the base layer configured to protect at least a portion of a metacarpal bone of the human hand. The athletic glove may include a volar metacarpal support member attached to the volar side of the base layer and configured to protect at least a portion of a carpometacarpal joint, a metacarpal bone, a metacarpal joint, and a proximal phalanx of a thumb of the human hand. The athletic glove may also include a volar distal phalange support member attached to the volar side of the base layer and configured to protect at least a portion of a distal phalanx of the thumb of the human hand. The athletic glove may also include a dorsal metacarpal support member attached to the dorsal side of the base layer and configured to protect at least a portion of the carpometacarpal joint, the metacarpal bone, the metacarpal joint, and the proximal phalanx of the thumb of the human hand. The athletic glove may also include a dorsal distal phalange support member attached to the dorsal side of the base layer and configured to protect at least a portion of the distal phalanx of the thumb of the human hand.

The present disclosure relates to an improved glove including an inner glove that provides protection to the bones and soft tissues of the hand, while still allowing full function and mobility to an athlete. In one embodiment, the athlete may be a lacrosse player, soccer player, hockey player, softball player, baseball player, and the like. The glove may be worn by a goalie or other athlete in a different position.

The inner glove may include one or more support members configured to provide support and stability to the first metacarpal phalangeal (MCP) joint (thumb) and/or the first distal interphalangeal joint (DIP). The one or more support members may also provide stability and protection to condylar joints such as the wrist joint, and metacarphophalangeal joints to help prevent avulsion fractures of the ulnar collateral ligament (UCL), crush fractures, and joint dislocation.

In one embodiment, the improved glove including the inner glove, may also include one or more reinforcement members located on the exterior of the glove. In one embodiment the reinforcement member may be located about the first MCP to prevent extension and abduction.

The improved glove may be worn by any athlete with a history of hand injury who needs extra protection or any athlete that wants to prevent injury to the hand.

DETAILED DESCRIPTION

The present disclosure relates to an athletic glove with an inner sleeve or inner glove. The inner glove has one or more strategically placed protective members configured to provide protection to the bones, joints, tendons, and ligaments in a player's hand.

Figure 1:
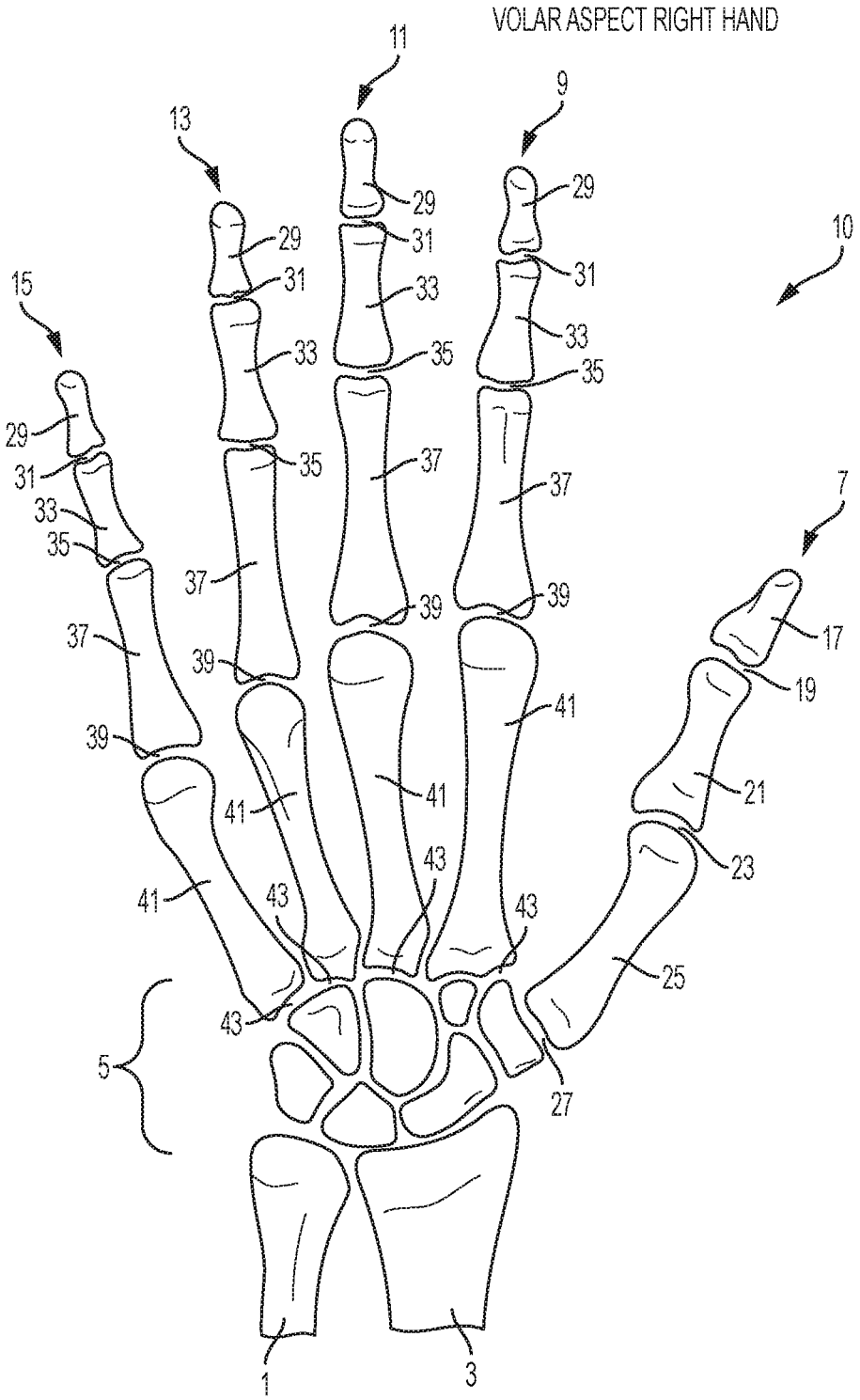
FIG. 1 depicts a schematic anatomical view of a right hand in a volar view configuration.

FIG. 1 depicts a schematic anatomical view of a right hand 10 in a volar view (i.e., palm-side view). As illustrated in FIG. 1, the hand 10 includes a first finger 7 (i.e., thumb), a second finger 9 (i.e., index finger), a third finger 11 (i.e., long finger), a fourth finger 13 (i.e., ring finger), and fifth finger 15 (i.e., small finger). The hand 10 includes a wrist 5, and connects to the ulna 1 and radius 3 bones of the forearm.

As illustrated in FIG. 1, the first finger 7 includes a distal phalanx 17, an interphalangeal (IP) joint 19, a proximal phalanx 21, a metacarpalphalangeal (MCP) joint 23, a metacarpal bone 25, and the carpometacarpal (CMC) joint 27.

As also illustrated in FIG. 1, the second finger 9, the third finger 11, the fourth finger 13, and the fifth finger 15 may have similar bone structures. In particular they each may include a distal phalanx 29, a distal interphalangeal (DIP) joint 31, a middle phalanx 33, a proximal interphalangeal (PIP) joint 35, a proximal phalanx 37, a metacarpalphalangeal (MCP) joint 39, a metacarpal bone 41, and the carpometacarpal (CMC) joint 43.

The distal phalanx 29, proximal phalanx 37, MCP joint 39, metacarpal bone 41, and CMC joint 43 of the second, third, fourth, and fifth fingers may be analogous to the distal phalanx 17, proximal phalanx 21, MCP joint 23, metacarpal bone 25 and CMC joint 27 of the first finger, respectively.

While the illustrated embodiment may refer to using this glove for lacrosse, it is understood that the described athletic glove could be used for various other sports to provide protection to a player's hand while the player is engaging in that sport. For example, in addition to lacrosse, the athletic glove may be used for baseball, boxing, ice hockey, and field hockey.

Figure 2A:
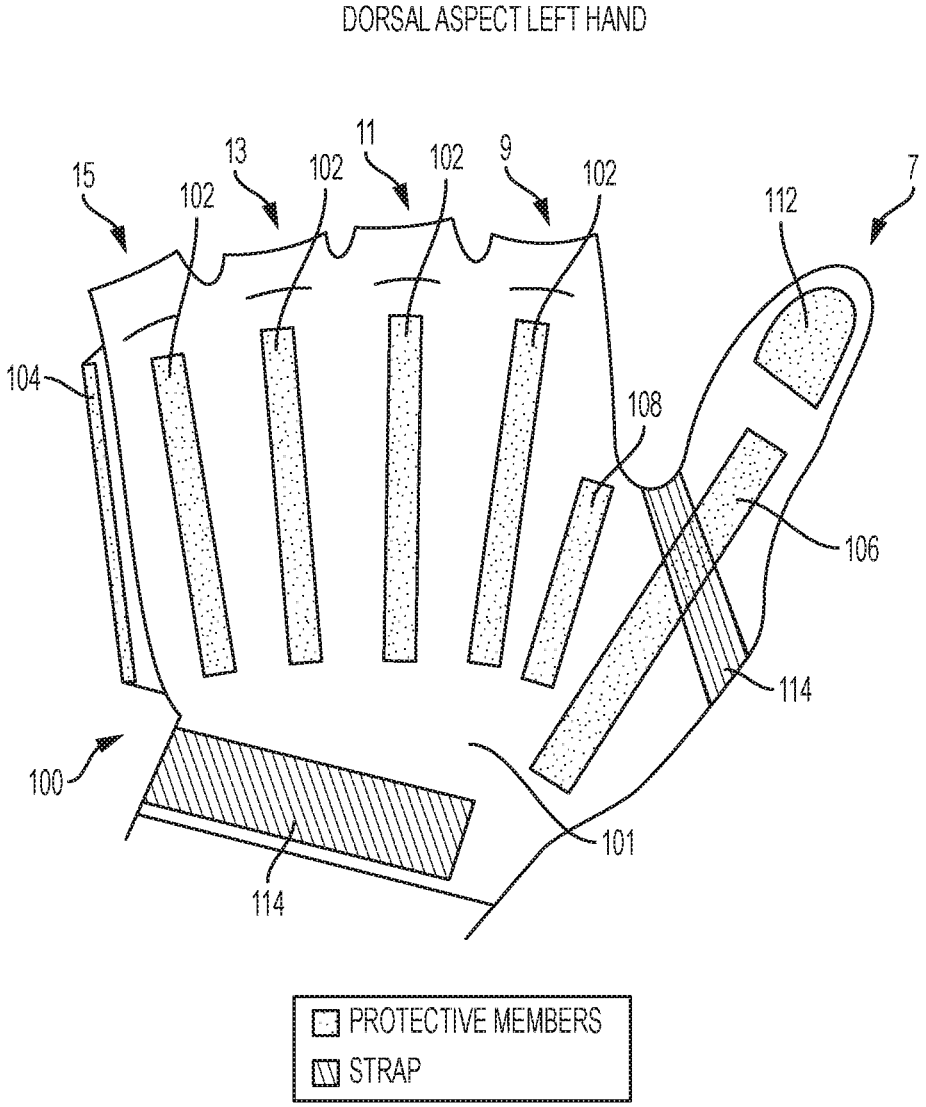
FIG. 2A depicts a dorsal aspect view of an exemplary inner glove, for the left hand, according to some embodiments of the present disclosure.
Figure 2B:
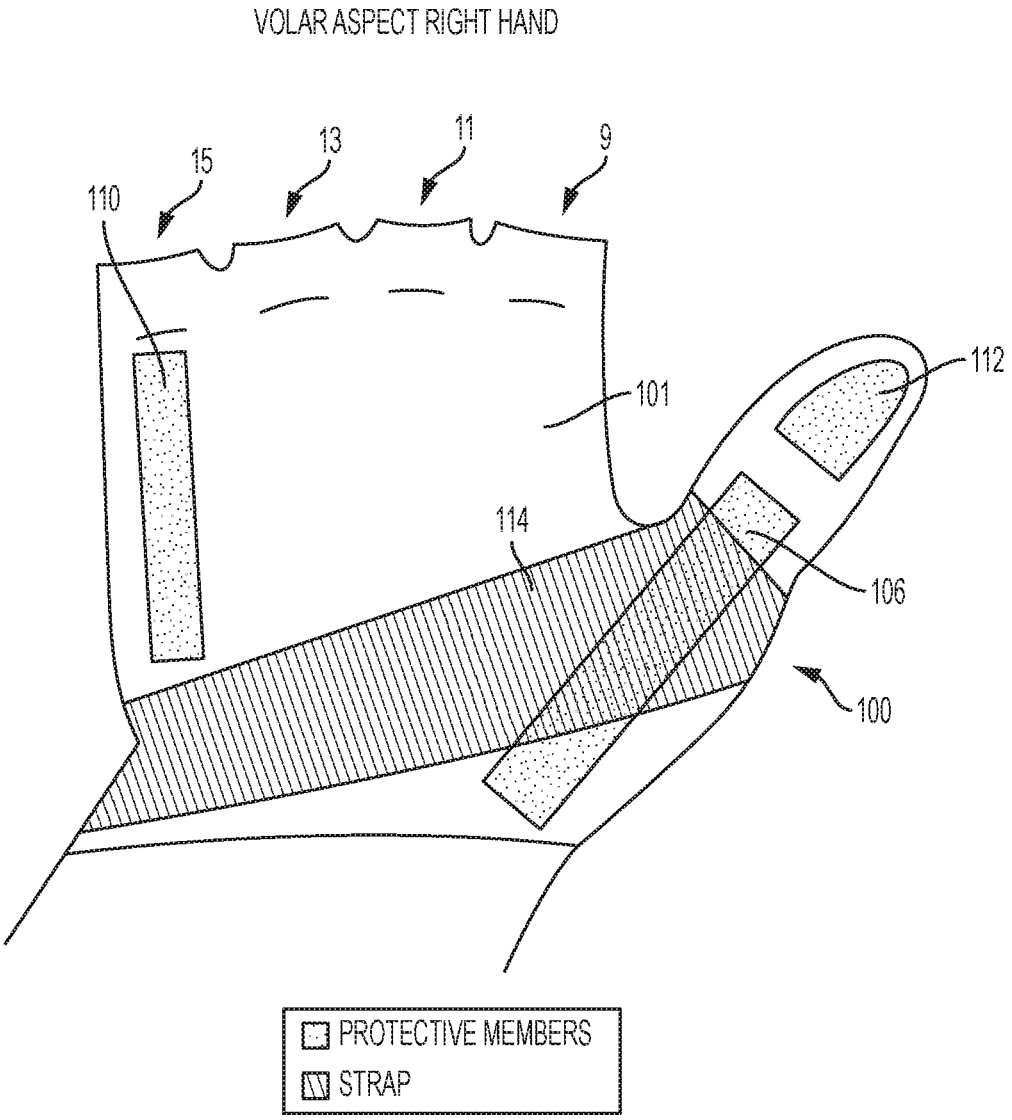
FIG. 2B depicts a volar aspect view of an exemplary inner glove, for the right hand, according to some embodiments of the present disclosure.
Figure 3A:
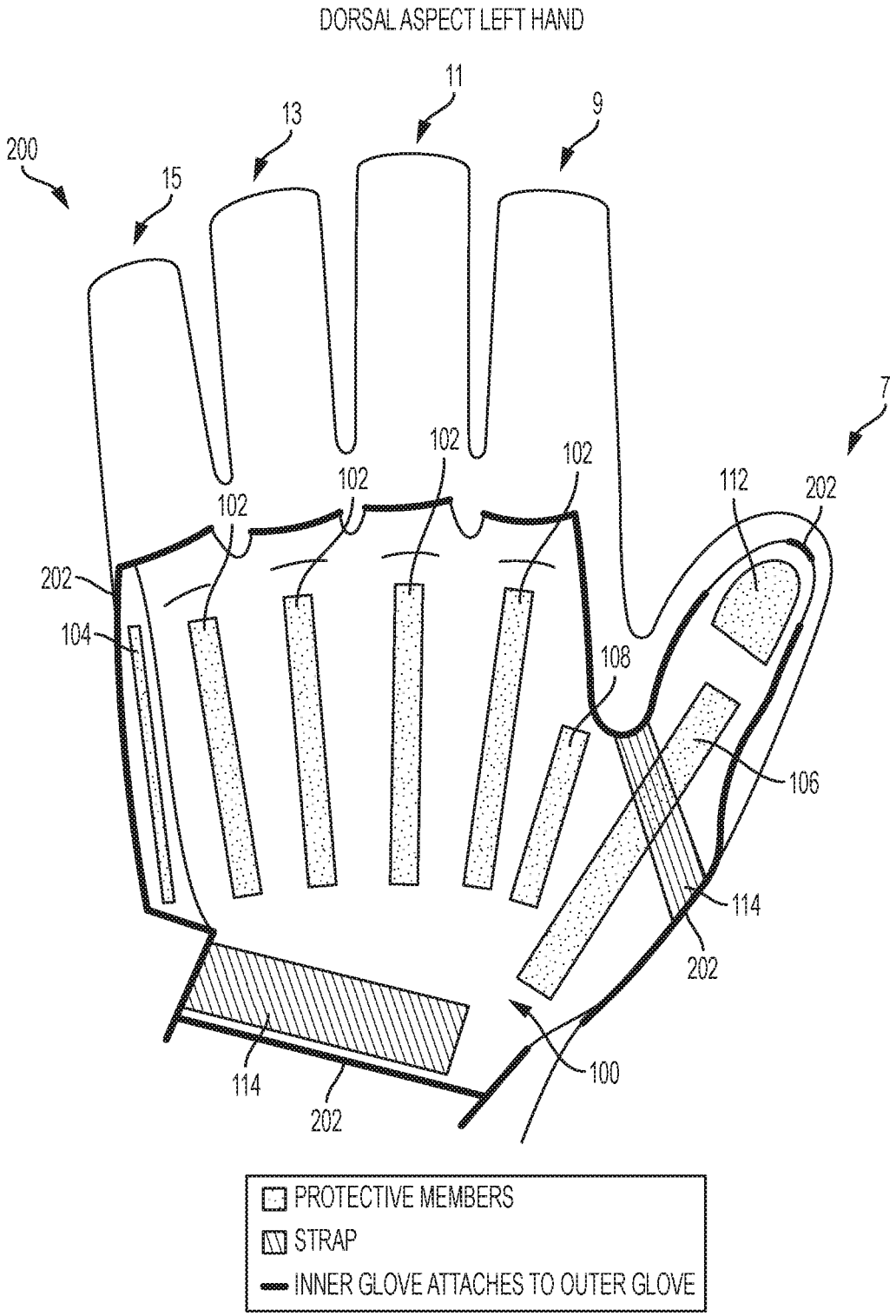
FIG. 3A depicts the exemplary inner glove of FIG. 2A within an outer glove, according to some embodiments of the present disclosure.
Figure 3B:
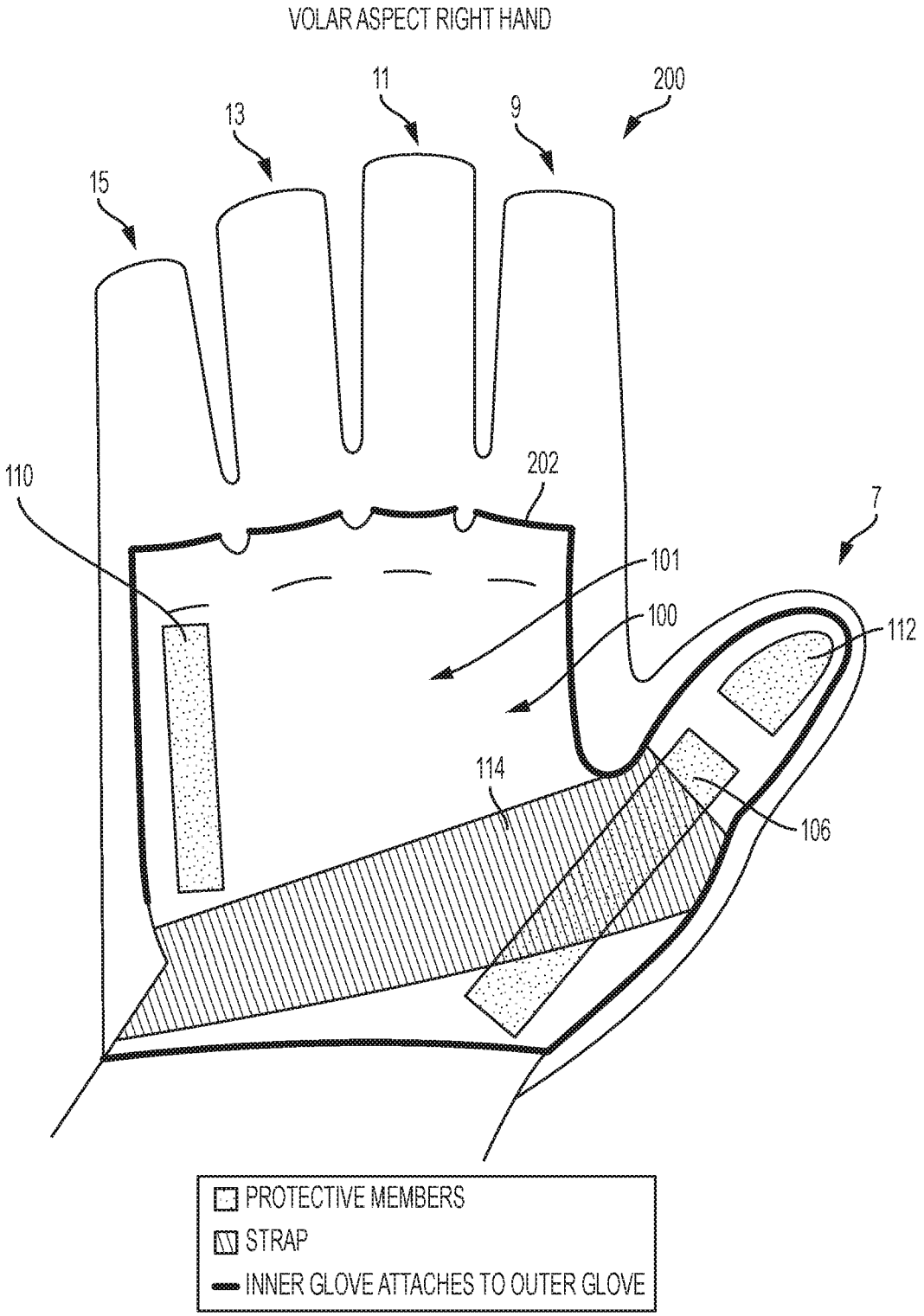
FIG. 3B depicts the exemplary inner glove of FIG. 2B within an outer glove, according to some embodiments of the present disclosure.

FIGS. 2A and 2B illustrate an exemplary inner glove having strategically placed protective members in accordance with an embodiment of the present disclosure. FIGS. 3A and 3B illustrate the inner gloves of FIGS. 2A and 2B, respectively, within an outer glove. Although right and left hand versions of the glove are depicted, one skilled in the art would recognize that the right and left hand versions may be mirror images and similar features may be present on both versions of the glove.

FIG. 2A depicts a dorsal aspect view (i.e., back of the hand view) of an exemplary inner glove 100, for the left hand, according to an embodiment of the present disclosure. As illustrated the inner glove 100 may include a base layer 101 and one or more protective members. Protective members may include metacarpal supports 102, ulnar border support 104, first metacarpal support 106, interspace support 108, distal phalange support 112, and/or strap 114, discussed in further detail below.

FIG. 2B depicts a volar aspect view (i.e., palm view) of an exemplary inner glove 100, for the right hand, according to some embodiments of the present disclosure. As illustrated the inner glove 100 may include the base layer 101 and one or more protective members. Protective members may include the first metacarpal support 106, distal phalange support 112, the hypothenar support 110, and/or the strap 114, discussed in further detail below.

As illustrated in FIGS. 2A and 2B, the inner glove 100 may include the base layer 101 configured to cover the palm or volar surface of the hand as well as the dorsal surface or back of the hand. The base layer 101 may include a mesh-like and breathable fabric. The base layer 101 may extend along the back of the hand and at least a portion of the second 9, third 11, fourth 13, and fifth 15 fingers as illustrated in FIG. 2A. The base layer 101 may also extend along the palm, back of the hand, and at least a portion of the second 9, third 11, fourth 13 and fifth 15 fingers as illustrated in FIG. 2B. As illustrated in FIGS. 2A and 2B, in one embodiment the inner glove 100 may be open at the second 9, third 11, fourth 13, and fifth 15 fingers, similar to a "fingerless" glove. For example, the inner glove 100 may extend approximately 0.25 inches from the palm towards the fingertips, but not cover the fingertips. In one embodiment, the base layer 101 of the inner glove 100 may enclose the thumb with a lightweight flexible fabric. One or more protective members may be attached to the base layer 101 by attachment means such as stitching or adhesives.

As illustrated in FIG. 2A, protective members may include metacarpal supports 102 configured to cover at least a portion of the metacarpal bone 41 of each of one or more of the second finger 9, third finger 11, fourth finger 13, and fifth finger 15. In one embodiment, the metacarpal supports 102 may be configured to cover the metacarpal bone 41 along the back of the hand (dorsal aspect). In one embodiment, the metacarpal supports 102 may be approximately about 4 cm in length, 0.8 cm in width, and 0.5 cm in depth. Additionally, the metacarpal supports 102 may rise approximately about 0.7 cm from the surface of the base layer 101. As one skilled in the art would recognize, the metacarpal supports 102 may be sized to fit the size and features of the hand being protected. A metacarpal support padding may be configured to be positioned between the athlete's hand and the metacarpal support 102 to provide additional comfort and shock absorption. The metacarpal support padding may include a foam or a gel material.

As illustrated in FIG. 2A, protective members may include ulnar border support 104. The ulnar border support 104 may be configured to protect the ulnar border of the lateral hand and hypothenar eminence protecting the fifth 15 metacarpal 41. The ulnar border support 104 may be made of plastic materials with underlying padding. In one embodiment, the ulnar border support 104 may be approximately about 5 cm in length, 0.8 cm in width, and 0.5 cm in depth. Additionally, the ulnar border support 104 may rise approximately about 0.7 cm from the surface of the base layer 101.

As illustrated in FIG. 2A, protective members may include an interspace support 108. As illustrated the inner glove 100 can include an interspace support 108 located at the dorsal metacarpal interspace between first 7 and second 9 metacarpals, 25, 29. In one embodiment, the interspace support 108 may be configured to cross over the first MCP joint 23 to limit excessive hyperextension and abduction.

As illustrated in FIGS. 2A and 2B, protective members may include a first metacarpal support 106 configured to cover at least a portion of the CMC joint 27, metacarpal bone 25, MCP joint 23, and proximal phalanx 21 of the first finger or thumb 7. The first metacarpal support 106 may be made of plastic materials. In one embodiment, the first metacarpal support 106 may be approximately about 6 cm in length, 1 cm in width, and 0.5 cm in depth. Additionally, the first metacarpal support 106 may rise approximately about 0.7 cm from the surface of the base layer 101 In one embodiment, first metacarpal supports 106 may be located along both the volar and dorsal aspects.

The protective members may also include a distal phalange support 112 configured to cover at least a portion of the distal phalanx 17 of the first finger or thumb 7. As illustrated in FIG. 2B, in one embodiment, the distal phalange support 112 may be separate and distinct from the first metacarpal support 106. This configuration may allow for flexibility, function, and motion at the IP joint 19. The distal phalange support 112 may be made of plastic materials. In one embodiment, the distal phalange support 112 may be approximately about 2 cm in length, 1.5 cm in width, and 0.5 cm in depth. Additionally, the distal phalange support 112 may rise approximately about 0.7 cm from the surface of the base layer 101. In an alternative embodiment, the distal phalange support 112 may be connected to the first metacarpal support 106 and/or be a single protective member made from plastic. In some embodiments, a separate plastic piece can be used to cover each of dorsal and volar distal phalange to allow for flexibility, function and motion at the interphalangeal joint of the thumb. In some embodiments, a single piece of plastic covering both the dorsal and volar aspects of the distal phalange can form distal phalange support 112.

The protective members may also include a hypothenar support 110 configured to cover at least a portion of the hypothenar muscles on the surface of the fifth finger in the volar aspect. The hypothenar support 110 may be made of hard protective material or a plastic strip. In one embodiment, the hypothenar support 110 may be approximately about 7 cm in length, 1 cm in width, and 0.5 cm in depth. Additionally, the hypothenar support 104 may rise approximately about 0.7 cm from the surface of the base layer 101.

The protective members may also include a strap 114. The strap 114 may be composed of neoprene or other materials. The strap 114 may be configured to originate at the dorsal MCP joint, pull medially across the volar hand or palm, travel along the proximal ulnar border, and then turn and pull distally before attaching to an outer glove. Strap 114 splits, surrounds and secures around the MCP joint. Strap 114 is adjustable and supports the joint. Strap 114 pulls medially across the volar hand and supports the joint while helping to prevent excessive abduction and hyperextension. Strap 114 then comes through the outer glove along the proximal ulnar boarder, turns to pull distally and attaches, with, for example, VELCRO™, to the top of the outer glove. Strap 114 can be a type of cotton cloth, polyester, or synthetic material or fabric that is less giving, less stretchy and more supportive. In one embodiment, the strap 114 may originate and attach to a base layer 101 on the dorsal side of the glove proximate the first metacarpal bone 25. The strap 114 may cover the first metacarpal support 106 and then then extend across the volar aspect of the hand as is illustrated in FIG. 2B. After extending across the volar aspect of the hand the strap 114 may extend over the proximal ulnar border and extend into the dorsal side of the glove. The strap 114 may terminate on the dorsal side of the glove by attaching to the an outer glove in a position near the fifth metacarpal joint. Alternatively, the strap 114 may terminate by attaching to the base layer 101.

Protective members including metacarpal supports 102, ulnar border support 104, first metacarpal support 106, interspace support 108, distal phalange support 112, strap 114, distal phalange support 112, and/or the hypothenar support 110 may each attach to the base layer 101 using stitching, adhesives, and the like.

Base layer 101 of the dorsal aspect of the glove may connect to the base layer 101 of the volar aspect to form a continuous garment.

FIG. 3A depicts the exemplary inner glove 100 of FIG. 2A within an outer glove 200, according to some embodiments of the present disclosure. FIG. 3B depicts the exemplary inner glove 100 of FIG. 2B within an outer glove 200, according to some embodiments of the present disclosure. Solid line 202 illustrates the one or more sections where inner glove 100 may attach to outer glove 200. The inner glove 100 may attach to the outer glove 200 using stitching, adhesives, and the like.

In one embodiment, the materials for the body of the glove and thumb, the base layer 101 may be composed of synthetic or natural fabrics and materials including one or more of the following: KEVLAR™, TWARON™, SPANDEX™, nylon, polyester, acrylic, lastex, ORLON™, CORDURA™, neoprene, mesh, breathable mesh, performance stretch materials, for example, LYCRA™, VELCRO™, leathers, acrylics, canvas and GORE-TEX™.

Protective members including metacarpal supports 102, ulnar border support 104, first metacarpal support 106, interspace support 108, distal phalange support 112, and/or the hypothenar support 110 be composed from hard/protective materials configured to protect bone and soft tissue from direct force. For example, moldable plastics can be used as well as synthetic fabrics and materials including KEVLAR™, TWARON™, SPANDEX™, nylon, polyester, acrylic, lastex, ORLON™, and CORDURA™. In some embodiments, forms of moldable clay may be used. In some embodiments, an orthoplastic may be used.

In some embodiments, the inner glove 100 may include soft or barrier materials configured to fit between the protective members (metacarpal supports 102, ulnar border support 104, first metacarpal support 106, interspace support 108, distal phalange support 112, and/or the hypothenar support 110) or strap 114 and the hand. In some embodiments these soft materials can include one or more of the following materials: high density foams (open and closed cell), adhesive foam, polyurethane foams, gel foam, reflex foam, memory foam, Evlon foam, moleskin, felt, rubber, padding, carbon fiber and gel padding.

In some embodiments, the strap 114 may be composed of neoprene, LYCRA™, Ariaprene™, Thermocline, KEVLAR™, TWARON™, SPANDEX™, nylon, polyester, acrylic, lastex, ORLON™, CORDURA™, mesh, performance stretch materials, leather, acrylics, canvas, GORE-TEX™ and the like.

In addition to the embodiment illustrated in FIGS. 2A-3B, it is envisioned that an athletic glove with an inner glove having protective members may be modified for optimal performance for a particular sport or athlete.

In one embodiment, individual reinforcing segments or protective members can be modified. For example, the metacarpal supports 102 may be composed of two or more pieces of plastic. The metacarpal supports 102 may be configured to cover the dorsal second 9, third 11, fourth 13 and fifth 15 metacarpals 41.

In another embodiment, the individual protective members encapsulating the first metacarpal 25, the proximal phalanx 21 and the dorsal metacarpal interspace can be combined to be one or more pieces.

In some embodiments, the individual protective members protecting the distal phalange of the thumb, or distal phalange support 112 on the dorsal and volar aspects, may be fabricated as one piece surrounding the tip of thumb similar to a "helmet."

In some embodiments, strap 114 encapsulating the MCP joint 23, 39 may be modified or removed.

In some embodiments, from the volar aspect, the palmar surface of the inner glove 100, also referred to as the base layer 101, may be cut out and opened. This fabric removal can be helpful because cutting a small area of material in the middle palm can take away a layer of unneeded fabric. The thenar and hypothenar protective sections are not affected. By removing this section, inner glove 100 may allow for more tactile sensation between the palm and athletic equipment such as a lacrosse stick. Removing this section may also allow for improved airflow, sweat wicking, and help keep the palm cool.

In some embodiments, the strap 114 may be independent of the inner glove and/or outer glove. In particular the strap 114 may be configured to provide protection and support to the thumb with or without the inner glove being connected to the outer glove.

In one embodiment, the strap 114 may include padding configured to provide protection to the MCP joint 23, and distal 17 and proximal 21 phalanges of the thumb. The glove with padded strap 114 may be used by athletes playing football, soccer, baseball, and/or softball.

In one embodiment, the strap 114 may include one or more individual segments configured to cover the metacarpal bones 25, 41 of the first 7, second 9, third, 11, fourth 13, and fifth 15 fingers. Additionally or alternatively, one or more pieces of plastic and/or padding may be placed over the palmar surface of the hand in order to protect the volar aspect of the hand. The glove with padding on the palmar surface may be used by athletes playing soccer, baseball, and/or softball.

In one embodiment, the inner glove 100 may be modified by removing the thumb spic and distal thumb protection and including individual plastic and/or padding segments over the dorsal metacarpals such that protection is provided to the dorsal aspect of the hand. Such an embodiment may be used by athletes playing lacrosse, ice hockey, and/or field hockey.

Although sizes for protective members may be given above, as one skilled in the art would recognize, the size of the protective member can be shortened or lengthened based on the size and features of the hand being protected.

Although the disclosed subject matter has been described and illustrated in the foregoing exemplary embodiments, it is understood that the present disclosure has been made only by way of example, and that numerous changes in the details of implementation of the disclosed subject matter may be made without departing from the spirit and scope of the disclosed subject matter.

The invention claimed is:

1. An athletic glove comprising:

an inner glove having a base layer sized to cover a palm, thumb, and at least a portion of the fingers of a human hand, the base layer having a dorsal side configured to span a dorsal aspect of the human hand and a volar side configured to span a volar aspect of the human hand;

one or more metacarpal support members attached to the dorsal side of the base layer, wherein each of the metacarpal support members is configured to protect at least a portion of a metacarpal bone of the human hand;

a volar metacarpal support member attached to the volar side of the base layer and configured to protect at least a portion of a carpometacarpal joint, a metacarpal bone, a metacarpal joint, and a proximal phalanx of a thumb of the human hand;

a volar distal phalange support member attached to the volar side of the base layer and configured to protect at least a portion of a distal phalanx of the thumb of the human hand;

a dorsal metacarpal support member attached to the dorsal side of the base layer and configured to protect at least a portion of the carpometacarpal joint, the metacarpal bone, the metacarpal joint, and the proximal phalanx of the thumb of the human hand;

a dorsal distal phalange support member attached to the dorsal side of the base layer and configured to protect at least a portion of the distal phalanx of the thumb of the human hand; and a strap having a first end and a second end spaced apart from the first end, wherein the first end of the strap is configured to attach to the base layer on the dorsal side proximate a first metacarpal bone of the human hand, the strap spans at least a portion of the volar side of the base layer, and the second end of the strap is configured to attach to at least one of the base layer on the dorsal side or an outer glove proximate a fifth metacarpal bone of the human hand.

2. The athletic glove of claim 1 wherein the base layer is composed of at least one of Poly-paraphenylene terephthalamide, para-amids, spandex, nylon, polyester, acrylic, lastex, neoprene, mesh, breathable mesh, performance stretch materials, leathers, acrylics, canvas and stretched polytetrafluoroethylene (PTFE).

3. The athletic glove of claim 1, wherein at least one of the one or more metacarpal support members, the volar metacarpal support member, the volar distal phalange support member the dorsal metacarpal support member and the dorsal distal phalange support member is composed of at least one of Poly-paraphenylene terephthalamide, para-amids, spandex, nylon, polyester, acrylic, lastex, moldable clay and orthoplastic.

4. The athletic glove of claim 1, wherein the strap is composed of at least one of neoprene, spandex, poly-paraphenylene terephthalamide, para-amids, Thermocline, nylon, polyester, acrylic, lastex, mesh, performance stretch materials, leather, acrylics, canvas, and stretched polytetrafluoroethylene (PTFE).

5. The athletic glove of claim 1, further comprising an ulnar border support member configured to protect at least a portion of a ulnar border of the human hand and a hypothenar eminence protecting a fifth metacarpal of the human hand, the ulnar border support member attached to the dorsal side of the base layer.

6. The athletic glove of claim 5, wherein the ulnar border support member is composed of at least one of spandex, poly-paraphenylene terephthalamide, para-amids, nylon, polyester, acrylic, lastex, moldable clay and orthoplastic.

7. The athletic glove of claim 1, further comprising an interspace support member configured to protect at least a portion of a dorsal metacarpal interspace located between a first and a second metacarpal bone of the human hand, the interspace support member attached to the dorsal side of the base layer.

8. The athletic glove of claim 7, wherein the interspace support member is composed of at least one of spandex, poly-paraphenylene terephthalamide, para-amids, nylon, polyester, acrylic, lastex, moldable clay and orthoplastic.

9. The athletic glove of claim 1, further comprising an outer glove configured to attach to the inner glove along an outer perimeter of the inner glove by way of at least one of an adhesive and stitching.

10. The athletic glove of claim 1, further comprising padding configured to be between a surface of the human hand and the one or more of the one or more metacarpal support members, the volar metacarpal support member, the volar distal phalange support member the dorsal metacarpal support member and the dorsal distal phalange support member.

11. The athletic glove of claim 10, wherein the padding is composed of at least one of high density closed cell foam, high density open cell foam, adhesive foam, polyurethane foam, gel foam, reflex foam, memory foam, Evlon foam, moleskin, felt, rubber, carbon fiber, and gel.

12. The athletic glove of claim 1, further comprising a hypothenar support member configured to protect at least a portion of the hypothenar muscles of a fifth finger of the human hand in the volar aspect, the hypothenar support member attached to the volar side of the base layer.

* * * * *